US005779573A

United States Patent [19]

You

[11] Patent Number: 5,779,573

[45] Date of Patent: Jul. 14, 1998

[54] GAME RACKET

[76] Inventor: Chin-San You, No. 6, Lane 477, Sec. 2, Feng-Shyn Rd., Feng Yuan City, Taichung Hsien, Taiwan

[21] Appl. No.: 857,303

[22] Filed: May 16, 1997

[51] Int. Cl.[6] ..... A63B 49/02; A63B 51/08

[52] U.S. Cl. ..... 473/543

[58] Field of Search ..... 473/524, 533, 473/540, 542, 548, 543

[56] References Cited

U.S. PATENT DOCUMENTS

| | | | |
|---|---|---|---|
| 4,322,076 | 3/1982 | Bertram et al. | 473/540 |
| 4,333,650 | 6/1982 | Soong | 473/540 |
| 4,437,662 | 3/1984 | Soong | 473/540 |
| 5,255,912 | 10/1993 | Tseng | 473/540 |
| 5,306,004 | 4/1994 | Soong | 473/542 X |
| 5,562,283 | 10/1996 | Davis et al. | 473/540 |

*Primary Examiner*—William E. Stoll

*Attorney, Agent, or Firm*—Browdy and Neimark

[57] ABSTRACT

A game racket comprises a head frame and a handle. The head frame has a throat portion and a crown portion opposite to the throat portion. The throat portion is provided with two first string holes and a plurality of second string holes located between the two first string holes. The portions other than the throat portion are provided with a plurality of first string holes for fastening the first string sections. The second string holes of the throat portion and the first string holes of the crown portion of the head frame are intended for fastening the second string sections radially to interlace the first string sections so as to form a ball-striking face of the head frame. The second string sections are fastened in pair in the second string holes. The distance between two adjoining second string holes and the distance between any one of the two first string holes of the throat portion and the adjoining second string hole of the throat portion are smaller than the distance between two adjoining first string holes of the crown portion of the head frame.

5 Claims, 4 Drawing Sheets

GAME RACKET

FIELD OF THE INVENTION

The present invention relates generally to a game racket, and more particularly to a ball-striking face of the game racket.

BACKGROUND OF THE INVENTION

The ball-striking face of the conventional game racket is generally formed by a plurality of main strings and cross strings interlacing the main strings such that the cross strings are perpendicular to the main strings.

In order to enhance the esthetic effect and the ball control effect of the ball-striking face of the game racket, the main strings of the conventional game racket are arranged in a radiate manner so that the main strings are spread out from the throat portion of the game racket. As a result, the density of the string holes in the throat portion of the head frame must be so intensified as to accommodate the radiate distribution of the main strings, even at the expense of the structural integrity and strength of the throat portion. In other words, such a throat portion as described above is vulnerable to crack or severance.

SUMMARY OF THE INVENTION

The primary objective of the present invention is to provide a game racket with a ball-striking face which is formed by a plurality of cross strings interlacing with a plurality of the radially-oriented main strings without undermining the structural strength of the head frame of the game racket.

In keeping with the principle of the present invention, the foregoing objective of the present invention is attained by a game racket, which consists of a head frame having a throat portion, and a handle. The head frame has a ball-striking face formed by a plurality of first string sections and second string sections interlacing the first string sections such that the second string sections are arranged radially from the throat portion of the game racket. The throat portion is provided with two first string holes, and three second string holes located between the two first string holes such that the distance between two adjoining second string holes and the distance between the first string hole and the adjoining second string hole are smaller than the distance between two adjoining first string holes located in the head frame portion opposite to the throat portion.

The foregoing objective, features and functions of the present invention will be more readily understood upon a thoughtful deliberation of the following detailed description of the embodiments of the present invention with reference to the accompanying drawings.

DETAILED DESCRIPTION OF THE INVENTION

Figure 1:
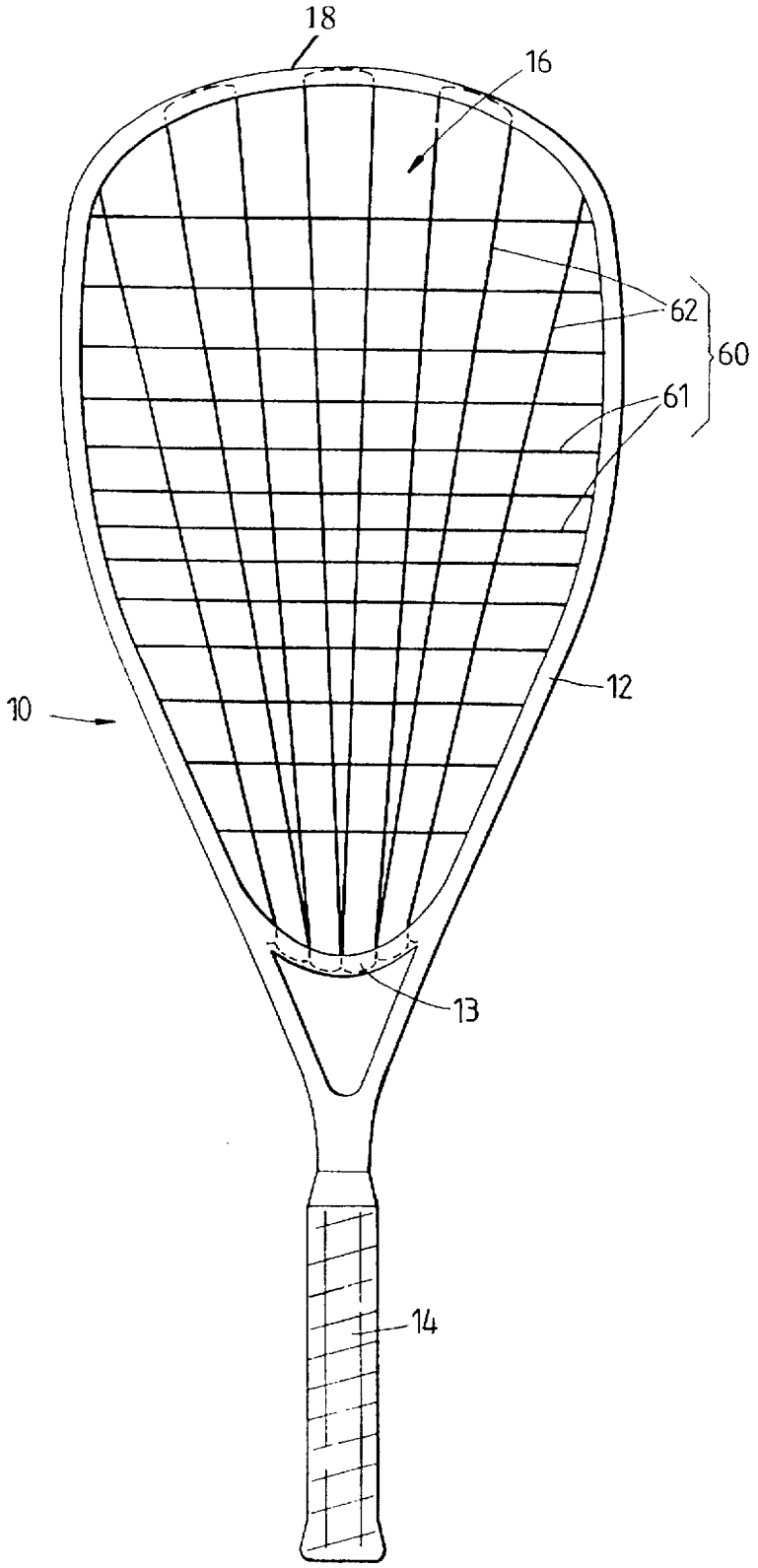
FIG. 1 shows a front view of a first preferred embodiment of the present invention.
Figure 2:
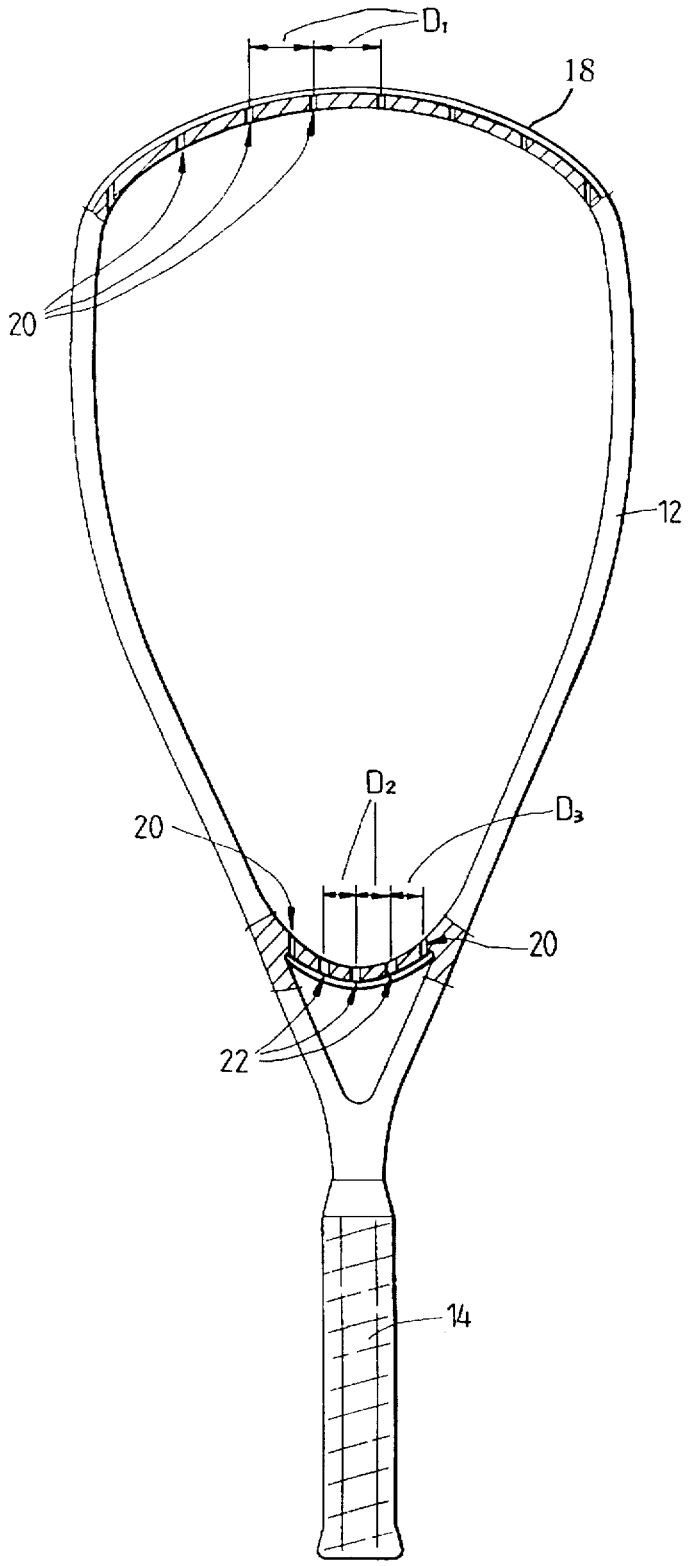
FIG. 2 shows a partial sectional view of the first preferred embodiment of the present invention.

As shown in FIGS. 1 and 2, a game racket 10 embodied in the present invention is composed of a head frame 12 and a handle 14 extending from a throat portion 13 of the head frame 12. The head frame 12 has a crown portion 18 opposite in location to the throat portion 13, and a ball-striking face 16 formed by a plurality of first string sections 61 (cross strings) and second string sections 62 (main strings) of a string 60. In other words, the ball-striking face 16 is in fact formed by the string 60, which is fastened repeatedly in the string holes of the head frame 12 to form a network of the ball-striking face 16.

The head frame 12 is provided with a plurality of first string holes 20 at selected locations. The throat portion 13 is provided with two first string holes 20 and three second string holes 22 located between the two first string holes 20 such that the distance D2 between two adjoining second string holes 22 and the distance D3 between any one of the two first string holes 20 of the throat portion 13 and the adjoining second string hole 22 are smaller than the distance D1 between two adjoining first string holes 20 located in the crown portion of the head frame 12, as illustrated in FIG. 2. The second string holes 22 are greater in inner diameter than the first string holes 20.

The ball-striking face 16 is formed by a plurality of first string sections 61 and second string sections 62. The first string sections 61 are held by the first string holes 20 such that the first string sections 61 traverse the head frame 12, as shown in FIG. 1. In addition, there are six second string sections 62 which interlace the first string sections 61 to form the ball-striking face 16. The six second string sections 62 are held in pairs by the three second string holes 22 of the throat portion 13 such that the second string sections 62 are arranged radially, and that the six second string sections 62 are held respectively at another end thereof by six first string holes 20 located in the crown portion 18 of the head frame 12. In addition, there are two second string sections 62 which are held by the two first string holes 20 of the throat portion 13. The structural strength of the throat portion 13 of the present invention is not undermined in view of the fact that the throat portion 13 has only three second string holes 22. Moreover, the ball-striking surface 16 of the present invention affords an excellent sweet zone which is formed by a plurality of densely-arranged first string sections 61 interlacing the second string sections 62, as shown in FIG. 1.

Figure 3:
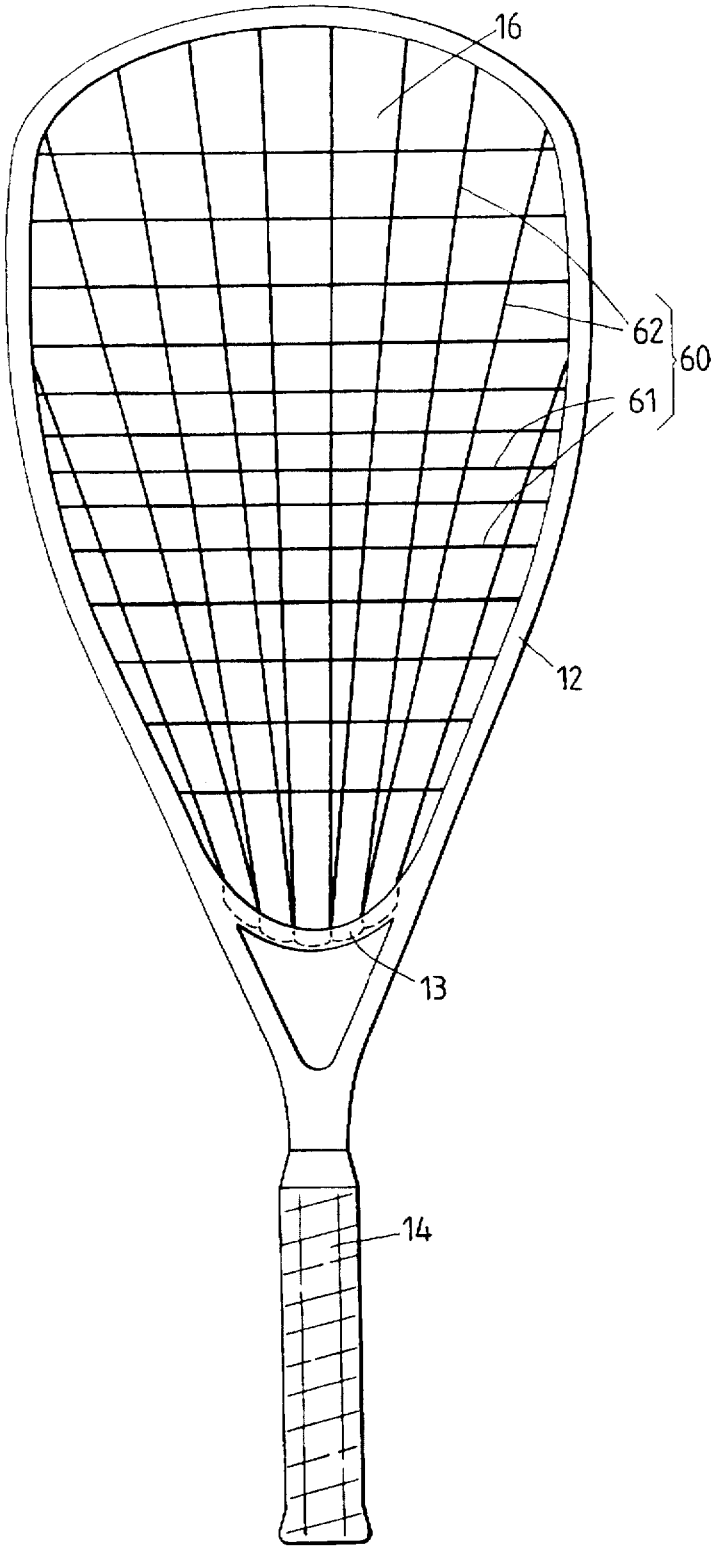
FIG. 3 shows a front view of a second preferred embodiment of the present invention.
Figure 4:
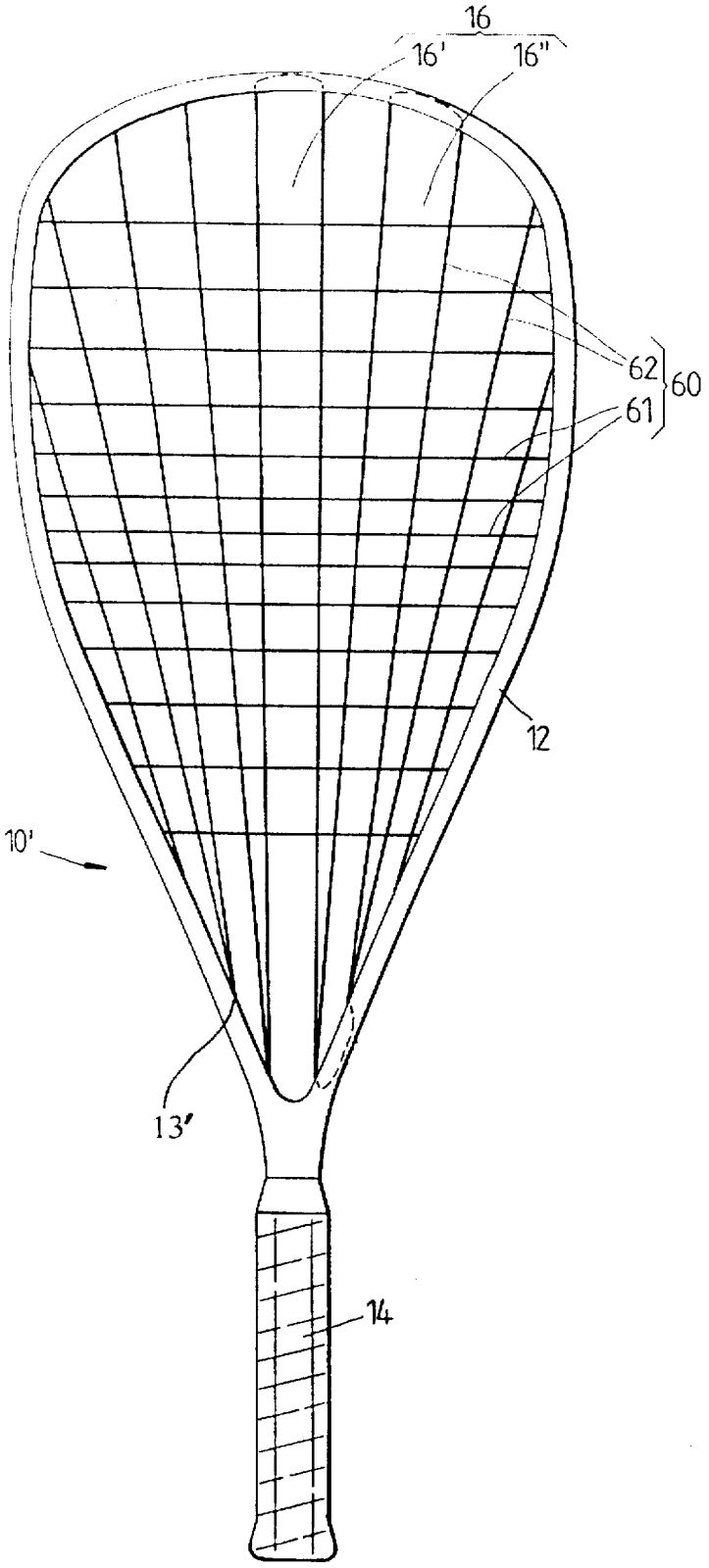
FIG. 4 shows a front view of a third preferred embodiment of the present invention.

The embodiment described above is intended for the illustrative purpose only. Accordingly, the present invention may be embodied in other specific forms without deviating from the spirit thereof. For example, the throat portion 13 of the present invention may be provided with the second string holes 22 in an even number such as 4, as shown in FIG. 3. Moreover, the present invention may be modified such that the game racket 10' of the present invention consists of a head frame 12 and a handle 14, and that the head frame 12 has a throat portion 13', which is formed as a unit with handle 14 13, as shown in FIG. 4. The head frame 12 has a throat portion which is V-shaped and contiguous with the handle 14 from which it extends. The V-shaped throat portion is used in place of the throat portion 13 and is provided with a plurality of second string holes 22 for fastening the second string sections 62 in a radiate manner that the second string sections 62 and the first string sections 61 form two integral parts 16' and 16" of the ball-striking face 16.

It is therefore readily apparent that the present invention is to be limited only by the scopes of the following appended claims.

What is claimed is:

1. A game racket comprising:

a head frame having a plurality of first string holes, a crown portion, and a throat portion opposite in location to said crown portion, said head frame further having a ball-striking face formed by a plurality of first string sections and second string sections formed by string; and a handle of a predetermined length and extending posteriorly from said throat portion of said head frame;

wherein said throat portion of said head frame is provided with a plurality of second string holes such that said second string holes are greater in diameter than said first string holes, and that a distance between two adjoining second string holes of said throat portion are smaller than a distance between two adjoining first string holes of said crown portion of said head frame;

wherein said string is fastened with said first string holes to form said first string sections;

wherein said string is fastened with said second string holes of said throat portion and said first string holes of said crown portion to form said second string sections such that said second string sections are arranged radially from said second string holes, and that each of said second string sections are respectively fastened in pairs in said second string holes.

2. The game racket as defined in claim 1, wherein said second string holes of said throat portion are even in number.

3. The game racket as defined in claim 1, wherein said second string holes of said throat portion are odd in number.

4. The game racket as defined in claim 1, wherein said throat portion of said head frame having two first holes, and that said second string holes are located between said two string holes;

wherein said string is fastened with said two first string holes of said throat portion and two first string holes of said crown portion to form two second string sections.

5. The game racket as defined in claim 1, wherein said throat portion having said second string holes is located in said head frame contiguous to and formed as a unit with said handle.

* * * * *